US006419420B2

(12) United States Patent
Hedlund

(10) Patent No.: US 6,419,420 B2
(45) Date of Patent: Jul. 16, 2002

(54) VIBRATING TAMPER HAVING A SINGLE CONTROL LEVER

(75) Inventor: Gunnar Hedlund, Karlskrona (SE)

(73) Assignee: Svedala Compaction Equipment AB, Karlskrona (SE)

( * ) Notice: Subject to any disclaimer, the term of this patent is extended or adjusted under 35 U.S.C. 154(b) by 54 days.

(21) Appl. No.: 09/726,356

(22) Filed: Dec. 1, 2000

(30) Foreign Application Priority Data

Dec. 1, 1999 (SE) ..... 9904361

(51) Int. Cl.[7] ..... E01C 19/35; E01C 19/32; F16H 21/54; F16C 1/12; G05G 1/00

(52) U.S. Cl. ..... 404/133.1; 74/104; 74/107; 74/110; 74/480 R; 74/491; 74/501.6

(58) Field of Search ..... 404/133.1; 172/40, 172/41; 74/40, 42, 44, 45, 47, 48, 49, 53–55, 104, 107, 110, 491, 480 R, 501.6

(56) References Cited

U.S. PATENT DOCUMENTS 382,101 A * 5/1888 McKnight
2,045,045 A * 6/1936 Moore ..... 74/491
3,847,034 A * 11/1974 Hemens ..... 74/491
3,899,263 A * 8/1975 Briggs et al. ..... 404/133
3,972,637 A * 8/1976 Sutherland ..... 404/133
4,156,575 A 5/1979 König et al. ..... 404/84
4,170,427 A * 10/1979 Grane ..... 404/133
4,195,534 A * 4/1980 Prince ..... 74/491
4,209,988 A 7/1980 Langworthy et al. ..... 60/431
4,573,543 A * 3/1986 Bataille ..... 180/19.1
4,775,263 A 10/1988 Persson et al. ..... 404/133
4,860,608 A * 8/1989 Kobayashi ..... 74/501.6
5,340,233 A * 8/1994 Motl ..... 404/133.05
5,733,071 A * 3/1998 Shudi ..... 405/271
6,047,609 A * 4/2000 Brower et al. ..... 74/473.19

* cited by examiner

*Primary Examiner*—Robert E. Pezzuto
*Assistant Examiner*—Raymond W. Addie
(74) *Attorney, Agent, or Firm*—Walter Ottesen

(57) ABSTRACT

The invention is directed to a vibrating tamper having a single control lever. The single control lever (4) can be set by an operator to any one of three releasably fixed positions with a snap-action detent device holding the control lever in the position selected by the operator. In the first position, the engine ignition is short-circuited, a fuel valve is closed, a fuel tank venting valve is closed and the throttle is fully closed. In the second position, the engine ignition circuit is enabled, the fuel tank venting valve is open, the fuel valve is open and the throttle control is in a starting/idling position. In the third position, the engine ignition circuit is enabled, the fuel tank venting valve is open, the fuel valve is open and the throttle control is in full-throttle position.

9 Claims, 7 Drawing Sheets

VIBRATING TAMPER HAVING A SINGLE CONTROL LEVER

BACKGROUND OF THE INVENTION

Previously known vibrating tampers are equipped with a number of different operating controls, such as a fuel valve, a closable fuel tank venting valve, a throttle control and a switch for stopping the engine. These controls are usually mounted in different positions on the tool and are not always easily accessible. Ease of access is a prerequisite to the safe operation of the vibrating tamper both when using the tool and during transport.

SUMMARY OF THE INVENTION

It is an object of the invention to simplify and make safer the use of vibrating tampers powered by internal combustion engines and designed for compacting clay, sand or gravel, for example in pipe trenches.

To achieve simple and safe operation of a vibrating tamper, the tool is, in accordance with the invention, equipped with a single control lever with three distinct snap-action positions with the following functions:

position 1: engine off, fuel valve closed and fuel tank venting valve closed;

position 2: throttle control in starting/idling position, fuel tank venting valve open and fuel valve open; and, position 3: throttle control in full-throttle position, fuel tank venting valve open and fuel valve open.

The different control lever settings are made distinct by means of a snap-action device which fixes the lever securely in the required position. This is important since the setting of an intermediate position during operation may, for example, damage the centrifugal clutch between the engine and the actual tamping mechanism. Ensuring that the fuel valve is closed when transporting the compactor is important since the tool will often be carried in a random manner. Otherwise, if the fuel valve is open, fuel may run into the engine oil, leading to subsequent engine failure, or leak out through the carburetor.

For safety reasons, it is essential for the fuel tank venting valve to be closed when transporting the tool to prevent fuel leakage through the venting valve. In the event of an emergency when using the tamper, the engine can be stopped easily by moving the control lever to position 1, in which the fuel supply and fuel tank venting valves are closed automatically.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
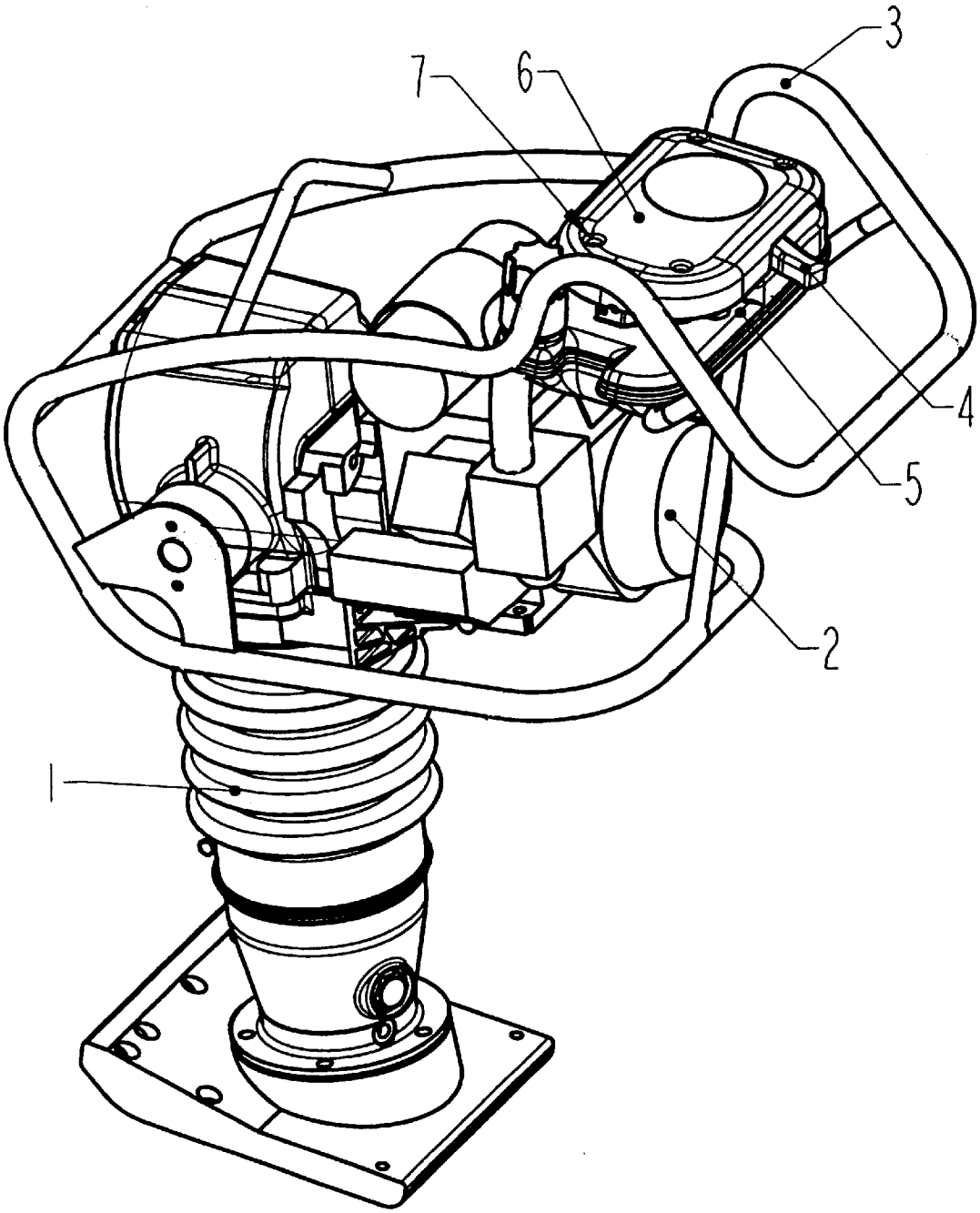
FIG. 1 is a perspective view of a vibrating tamper with a control lever mounted integrally on the fuel tank.

FIG. 1 shows a vibrating tamper 1 with the control handle 3 and the internal combustion engine 2 which drives the tamper mechanism. The fuel tank is identified by reference numeral 5 and a control lever 4 is mounted integrally on the fuel tank. The cover 6 of the control lever 4 is bolted to the fuel tank.

Figure 2:
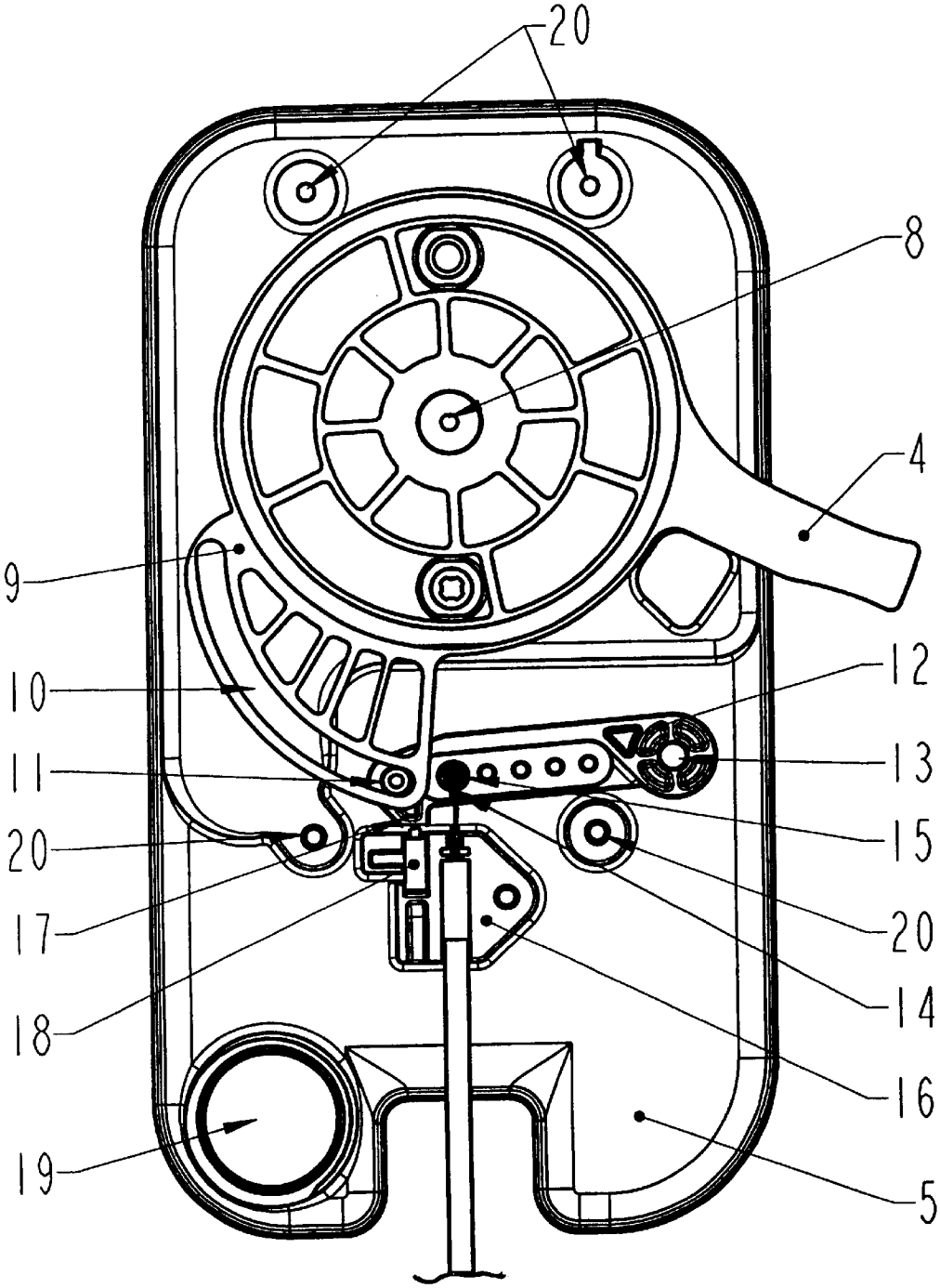
FIGS. 2 to 4 are schematic plan views showing the positions 1 to 3 of the control lever with the cover removed, with FIG. 2 showing position 1 wherein all functions are closed, FIG. 3 showing position 2 which is the starting and idling position and FIG. 4 showing position 3 which is the full-load position.

FIG. 2 shows the control lever 4, which is free to rotate about its pivot center 8 and is provided with a projecting section 9 with a full-length curved cam slot 10 whose distance from the pivot center 8 decreases continuously as shown. The pivot arm 12 is free to pivot on its journal 13. The free-running pin 11 is attached to pivot arm 12 and runs in the curved cam slot 10.

The end of the engine throttle cable 14 is seated in a hole 15 on the pivot arm 12 with its sleeve attached to the plate 16. In the position shown, the engine throttle is fully closed and increases to full throttle as the control lever 4 is turned and the other end of the curved cam slot 10 is reached. The outer end of the pivot arm 12 is provided with a projection 17 which, in the position shown, actuates a microswitch 18 which short-circuits the engine ignition circuit. In the case of a diesel engine, the engine is stopped in the position shown since the throttle is fully closed. The fuel tank filler pipe is identified by reference numeral 19 and the internally threaded bosses 20 are provided for bolting the cover 6 of the control lever 4 into position.

Figure 3:
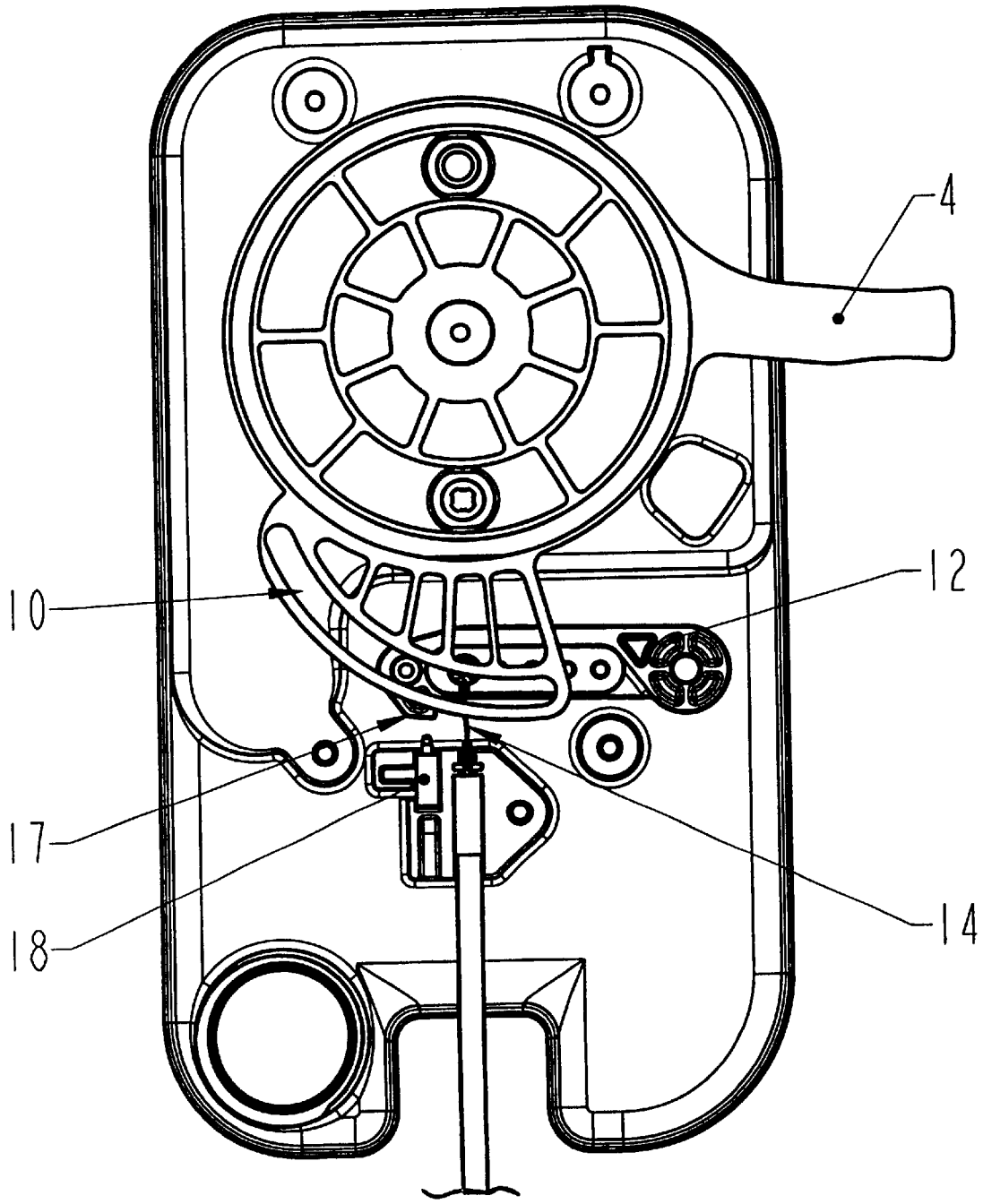

FIG. 3 shows the control lever in the starting and idling position. In this position, the pivot arm 12 has been actuated by the movement of the curved cam slot thereby pulling the throttle cable into the starting/idling position in which the projection 17 on the pivot arm 12 no longer operates the microswitch 18.

Figure 4:
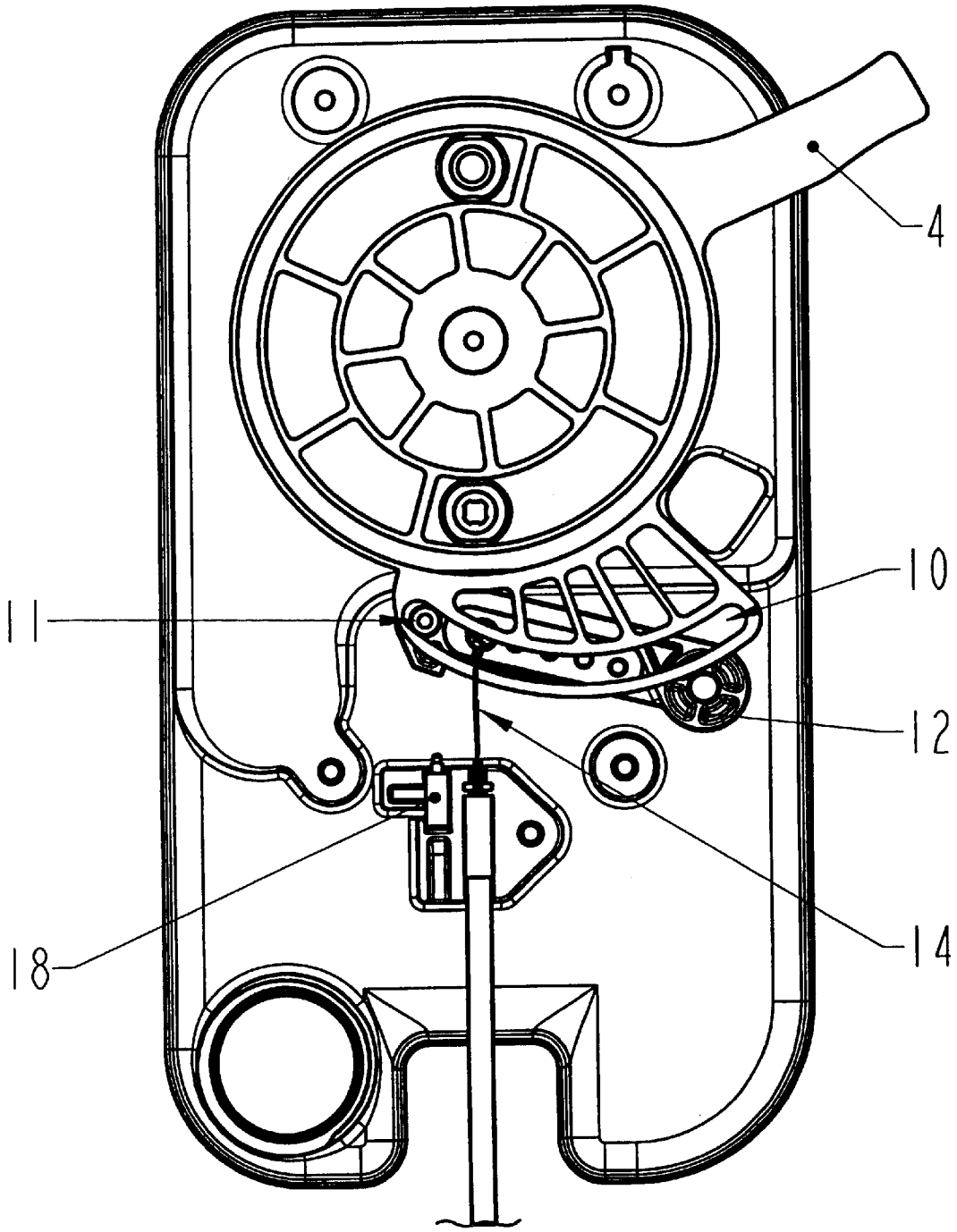

FIG. 4 shows the control lever 4 in the full-throttle position, which is reached when the control lever has been moved to its end position, at which the pin 11 acting in the curved cam slot 10 has pivotally moved the pivot arm 12 so that the throttle cable 14 is pulled out to its full-throttle position. The microswitch 18 remains unactuated.

Figure 5:
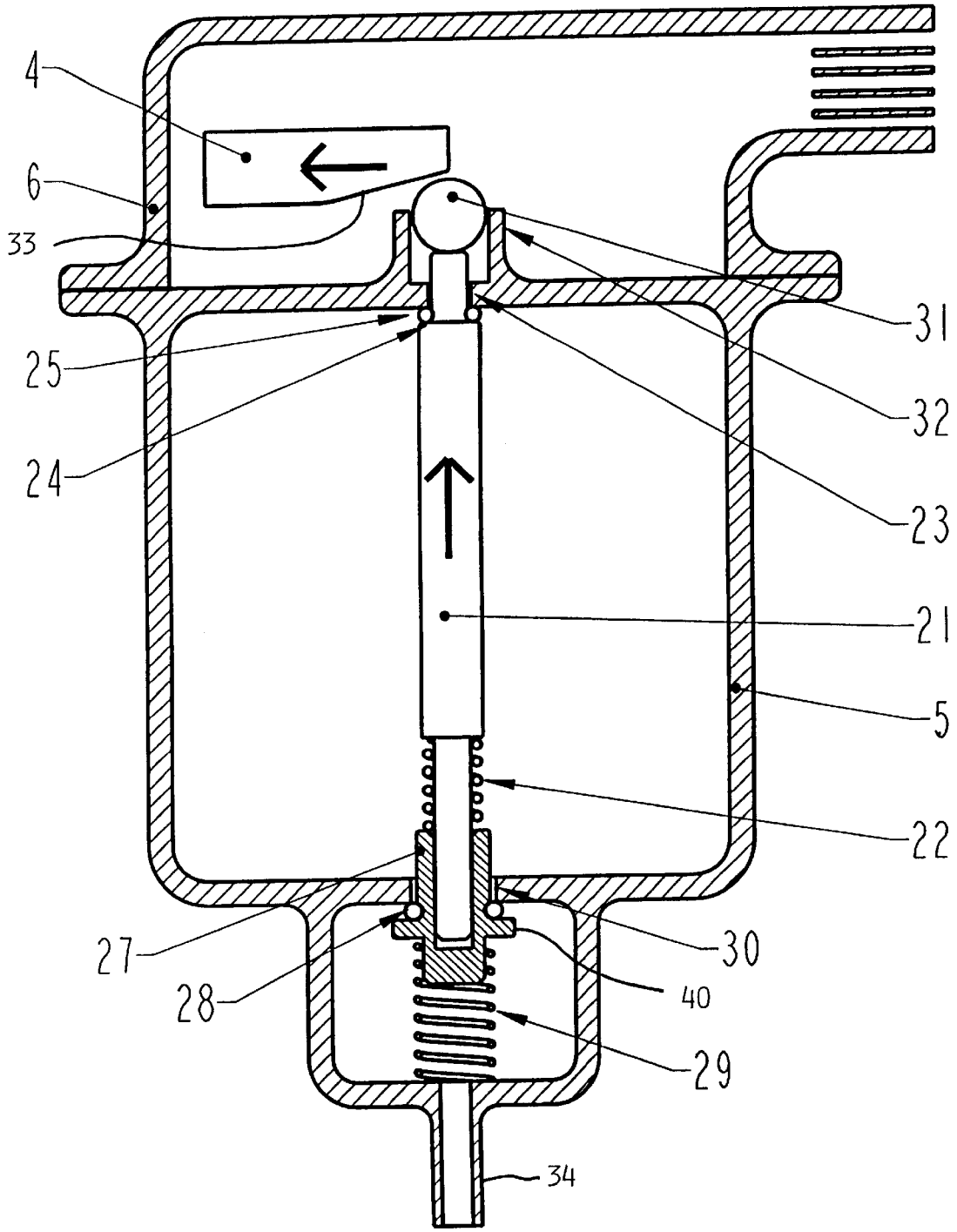
FIG. 5 is a schematic vertical section through the fuel tank showing the control lever in position 1.

FIG. 5 is a schematic vertical section through the fuel tank 5 and control lever cover 6 when the control lever 4 is in position 1 shown in FIG. 2. FIG. 5 shows a valve spindle 21, which is held against the tank vent opening 23, by the upward force of the spring 22 so that the shoulder 24 on the spindle and O-ring 25 seal the opening. The lower section of the valve spindle runs freely in a cylindrical valve sleeve 27 without bottoming in the sleeve. The valve sleeve 27 is provided with a collar 40 which is acted upon by the spring 29 to seal the outlet opening 30 in the tank 5 by pressing an O-ring 28 against the opening. The upper section 21 of the valve spindle runs through the tank vent opening 23 to act on a ball 31, which is free to move in a cylindrical sleeve 32 on the top of the tank and, in certain positions, is acted on by the underside of the control lever 4. The control lever 4 does not act on the ball 31 in the position shown, with the result that both the tank outlet and vent are closed. An air filter 26 is fitted in the control lever cover 6.

Figure 6:
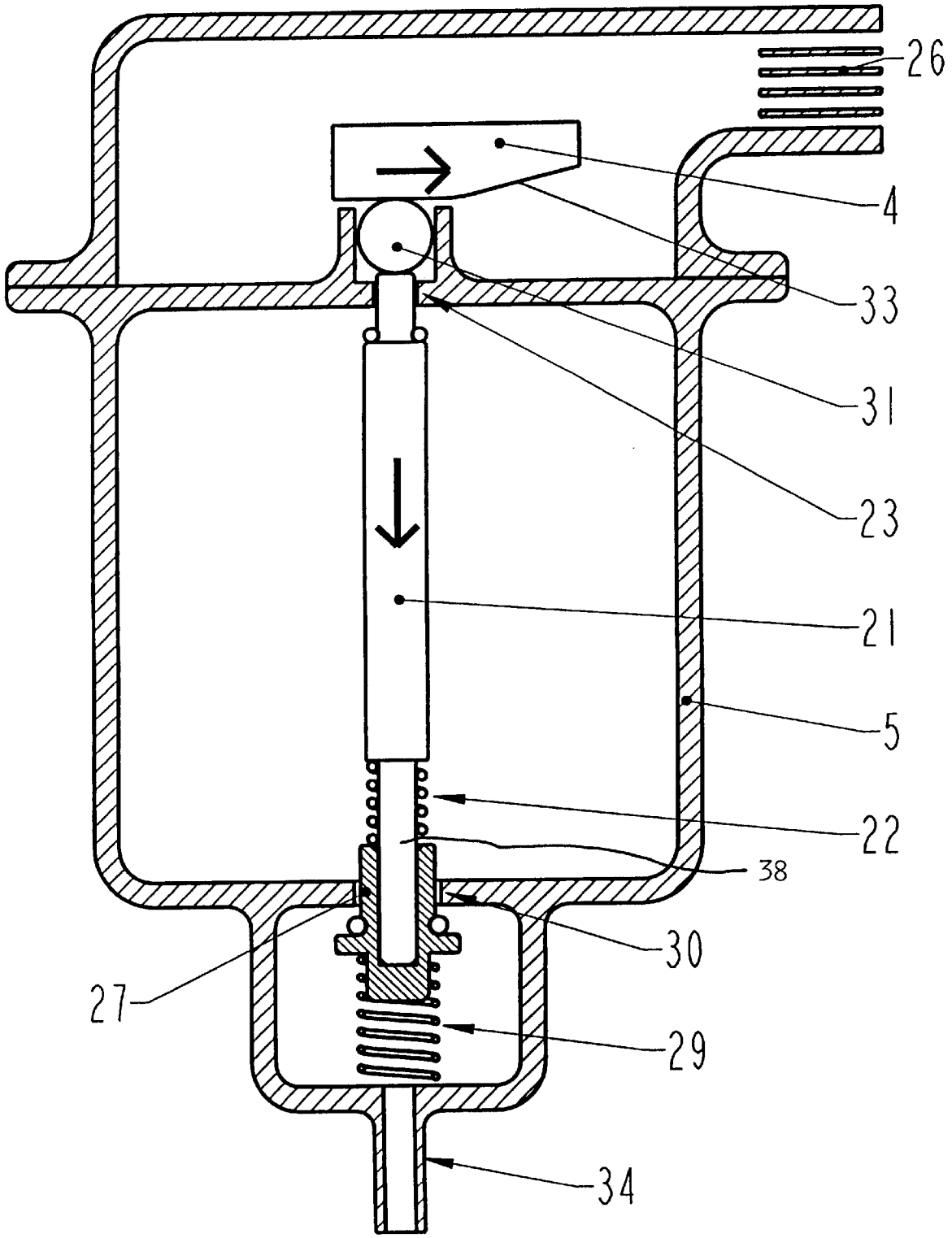
FIG. 6 is a similar schematic vertical section with the control lever in position 2 or 3; and, FIG. 7 is a schematic of the snap-action device used to releasably fix the control lever in the various positions 1 to 3.

FIG. 6 is a schematic vertical section through the fuel tank 5 and control lever cover 6 when the control lever 4 is in position 2 or 3. FIG. 6 shows that the chamfered surface 33 on the control lever 4 has pressed the ball 31 downward with the result that the valve spindle 21 has been forced downward, first opening the tank vent 23 and, when the lower end portion 38 of the spindle has bottomed in the valve sleeve 27, opening the outlet 30 of the fuel tank 5. By making the spring 22 weaker than the spring 29, the tank vent is opened before the fuel tank outlet 30. The fuel supply line to the engine is connected to the pipe stub 34 in a conventional manner.

Figure 7:
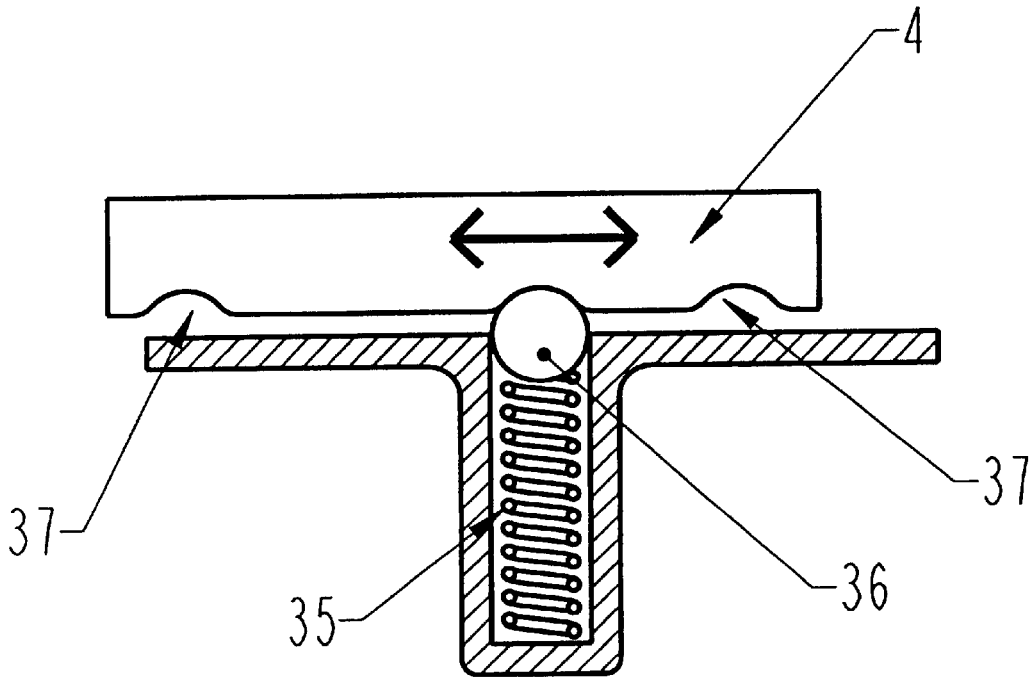

FIG. 7 is a schematic view of a ball-type snap-action detent device 35 which serves to releasably fix the control lever 4 in its different positions by pressing a ball 36 into hemispherical recesses 37 located in the control lever so as to correspond to the engine off, starting/idling and full-throttle positions. FIG. 7 shows the ball in the starting/idling position.

The invention simplifies and makes safer the use of vibrating tampers 1 powered by internal combustion engines and designed for compacting clay, sand and gravel, for example, in pipe trenches.

The invention is not limited to the embodiment described, but can also be applied to other internal combustion engine-powered machines or tools, such as vibrating compactors.

It is understood that the foregoing description is that of the preferred embodiments of the invention and that various changes and modifications may be made thereto without departing from the spirit and scope of the invention as defined in the appended claims.

What is claimed is:

1. A vibrating tamper comprising:

a reciprocating tamper; an internal combustion engine operatively connected to said reciprocating tamper, and having an ignition circuit and a throttle control movable between a fully closed position, a starting/idling position and a full-throttle position;

a microswitch movable between closed and open positions wherein said ignition circuit is disabled and enabled, respectively;

a fuel tank operatively connected to said engine to supply fuel thereto;

said fuel tank having a fuel valve movable between closed and open positions and a venting valve likewise moveable between closed and open positions;

said fuel valve and said venting valve conjointly defining a valve assembly;

a control lever pivotally mounted on said fuel tank to pivot about a first pivot axis;

said control lever including actuating means for acting on said valve assembly to move said fuel and venting valves between said closed and open positions;

said control lever having a curved cam slot formed therein and said slot having a curvature defining a radial distance measured from said first pivot axis which varies from a minimum radial distance at one end of said cam slot to a maximum radial distance at the other end of said cam slot;

a pivot arm pivotally mounted on said fuel tank to pivot about a second pivot axis;

said pivot arm being connected to said throttle control and having a free-running cam pin mounted thereon at a distance from said second pivot axis;

said cam pin slidably engaging said cam slot so as to permit said pivot arm to pivot about said second pivot axis when said control lever is rotated about said first pivot axis;

said control lever being pivotally moveable between:

(a) a first position wherein said lever arm actuates said microswitch to disable said ignition circuit and wherein said fuel tank valve and said venting valve are in their respective closed positions and said throttle control is in said fully closed position;

(b) a second position wherein said lever arm actuates said microswitch to enable said ignition circuit and said actuating means acts on said valve assembly for moving said fuel and venting valves into said open positions thereof and wherein said throttle control is moved into a starting/idling position; and, (c) a third position wherein said ignition circuit remains enabled, said fuel and venting valves remain in said open positions thereof and said throttle control is moved into said full-throttle position; and, a detent device for releasably holding said control lever in said positions.

2. The vibrating tamper of claim 1, said detent device being a ball-type snap-action device comprising:

recesses formed in said control lever corresponding to respective ones of said positions 1 to 3;

a detent ball; and, resilient biasing means for resiliently biasing said detent ball against said control lever so as to push and hold said detent ball in one of said recesses thereby releasably holding said control lever in a selected one of said positions.

3. The vibrating tamper of claim 1, said control lever being a single control lever.

4. The vibrating tamper of claim 1, said pivot arm having a projection formed on the free end thereof for contact engaging said microswitch in said first position of said control lever.

5. The vibrating tamper of claim 1, said throttle control comprising an engine throttle cable attached to said pivot arm.

6. The vibrating tamper of claim 1, said valve assembly comprising:

a displaceable spindle extending through said tank;

said venting valve including: a venting opening formed in the upper wall of said tank; a shoulder formed on said spindle; a first O-ring seal on said shoulder; and, a first spring for resiliently biasing said spindle in a direction to press said first O-ring seal against said upper wall around said venting opening thereby holding said venting valve in said closed position;

said fuel valve including: a fuel opening in the lower wall of said tank; a valve sleeve for receiving said spindle therein and said valve sleeve being disposed in said fuel opening; a second O-ring seal mounted on said valve sleeve; and, a second spring for resiliently biasing said valve sleeve and said second O-ring seal against said lower wall around said fuel opening thereby holding said fuel valve in said closed position thereof; and, said control lever having a chamfer thereon for acting on said spindle to displace the latter and open said valves when said control lever is moved into said second position.

7. The vibrating tamper of claim 6, said valve sleeve being configured to permit said displaceable spindle to move therein over a predetermined distance before said spindle bottoms and entrains said spindle whereby said venting valve opens before said fuel valve when said control lever is moved into said second position.

8. The vibrating tamper of claim 7, wherein said first spring is configured to be weaker than said second spring.

9. The vibrating tamper of claim 8, wherein said element is so configured that said control lever holds said displaceable spindle in the displaced position when said control lever is moved into said third position.

* * * * *